US005607514A

United States Patent [19]

Takeda et al.

[11] Patent Number: 5,607,514

[45] Date of Patent: Mar. 4, 1997

[54] CLEANING APPARATUS

[75] Inventors: Yutaka Takeda, Kawanishi; Mamoru Kamitani, Nara, both of Japan

[73] Assignee: Chugai Ro Company, Ltd., Osaka-fu, Japan

[21] Appl. No.: 429,563

[22] Filed: Apr. 27, 1995

[51] Int. Cl.[6] ..... B08B 3/10

[52] U.S. Cl. ..... 134/12; 134/21; 134/25.4; 134/107; 134/108; 134/200

[58] Field of Search ..... 134/105, 107, 134/108, 200, 11, 12, 21, 25.4

[56] References Cited

U.S. PATENT DOCUMENTS

| | | | |
|---|---|---|---|
| 1,338,308 | 4/1920 | Krouse | 134/105 |
| 3,111,952 | 11/1963 | Roehl | 134/105 |
| 3,613,699 | 10/1971 | Holm | 134/105 X |
| 4,029,517 | 6/1977 | Rand . | |
| 4,098,005 | 7/1978 | Wiarda . | |
| 4,261,111 | 4/1981 | Rand . | |
| 4,290,439 | 9/1981 | Charpentier | 134/107 |
| 4,339,283 | 7/1982 | McCord . | |
| 4,353,323 | 10/1982 | Koblenzer | 134/107 X |
| 4,879,004 | 11/1989 | Oesch et al. | 134/105 X |
| 4,983,223 | 1/1991 | Gessner . | |
| 5,045,117 | 9/1991 | Witherell | 134/108 X |
| 5,273,589 | 12/1993 | Griswold et al. | 134/105 X |
| 5,370,143 | 12/1994 | Takahashi . | |
| 5,401,322 | 3/1995 | Marshall . | |

FOREIGN PATENT DOCUMENTS

| | | | |
|---|---|---|---|
| 0098811 | 10/1986 | European Pat. Off. . | |
| 0581113 | 2/1994 | European Pat. Off. . | |
| 2296025 | 7/1976 | France | 134/108 |
| 278157 | 4/1990 | Germany | 134/105 |
| 285934 | 1/1991 | Germany . | |
| 4208665 | 4/1994 | Germany . | |
| 5155661 | 11/1995 | Germany . | |
| 54-113965 | 9/1979 | Japan . | |
| 56-115676 | 9/1981 | Japan . | |
| 58-210888 | 12/1983 | Japan . | |
| 63-193588 | 12/1988 | Japan . | |
| 63-302903 | 12/1988 | Japan . | |
| 3101881 | 4/1991 | Japan . | |
| 398683 | 4/1991 | Japan . | |
| 349633 | 7/1991 | Japan . | |
| 1205624 | 9/1970 | United Kingdom . | |
| 1419990 | 1/1976 | United Kingdom . | |
| 1536605 | 12/1978 | United Kingdom . | |

OTHER PUBLICATIONS

WPI Accession No. 91–203584/28 & JP 3127676A (Yamazaki) Abstracts.

*Primary Examiner*—Frankie L. Stinson

*Attorney, Agent, or Firm*—Birch, Stewart, Kolasch & Birch, LLP.

[57] ABSTRACT

The cleaning apparatus of the present invention is composed of a cleaning chamber 1 of vacuum-tight structure in which a work W to be cleaned is contained, an organic solvent vapor generating tank 4 communicated with the cleaning chamber 1 via piping, and a vacuum pump 6 for evacuating the cleaning chamber 1. A heat exchange member 3 through which a cooling medium passes is provided upside in the cleaning chamber 1. After the cleaning chamber 1 is reduced in pressure, the cooling medium is supplied into the heat exchange member 3 while organic solvent vapor is introduced from the vapor generating tank 4 into the cleaning chamber 1. Thus, a cleaning process is executed in combination of vapor cleaning by the vapor condensing on the surface of a work W and shower cleaning by the vapor being liquefied by the heat exchange member 3 and dropping onto the work W.

9 Claims, 8 Drawing Sheets

CLEANING APPARATUS

BACKGROUND OF THE INVENTION

1. Field of the Invention

The present invention relates to a cleaning apparatus, and more particularly to a cleaning apparatus for cleaning a mechanical part and the like (hereinafter, referred to as a work) with oil or the like adhering thereto by organic solvent vapor.

2. Description of the Prior Art

As this type of cleaning apparatus, there has conventionally been known a cleaning apparatus comprising a cleaning chamber of vacuum-tight structure, an organic solvent vapor generating tank (hereinafter, referred to as a vapor generating tank) communicated with the cleaning chamber via piping, and a vacuum pump for evacuating the cleaning chamber, such as shown in Japanese Patent Laid-Open Publication No. 54-113965 and Japanese Utility Model Laid-Open Publication No. 63-193588.

In this cleaning apparatus, organic solvent vapor (hereinafter, referred to as vapor) is supplied from the vapor generating tank into the cleaning chamber. The supplied vapor comes into contact with the surface of a work contained in the cleaning chamber, where it is condensed to make dew. Then the condensed organic solvent fluidly moves on the surface of the work to drop down, whereby the cleaning is executed.

However, the conventional cleaning apparatus as described above has the following problems.

That is, the temperature of the work surface increases gradually to become equal to that of the vapor, such that the vapor does not condense on the work. In this event vapor cleaning can no longer be executed, resulting in a shortage of cleaning time and therefore defective cleaning. As another problem, when the work is a hard-to-clean part such as parts having complex configurations, parts with high-viscosity oil adhering thereto, or parts with large amounts of oil adhering thereto, the cleaning cannot be resumed until the temperature of work surface decreases enough, by interrupting the vapor supply. As a result, longer processing time is involved.

As yet another problem, when the low-temperature used cleaning liquid accumulated in lower part of the cleaning chamber is returned to the vapor generating tank, the temperature of the organic solvent within the tank would become lower so that the amount of vapor generation decreases, so that the amount of vapor supply decreases. As a result, it would be impossible to achieve a sufficient cleaning, in particular, of the aforementioned hard-to-clean parts.

SUMMARY OF THE INVENTION

It is accordingly an object of the present invention to provide a cleaning apparatus which can accomplish a sufficient vapor cleaning by controlling the increase in the temperature of the work surface with a simple mechanism additionally provided, and which can perform a sufficient vapor cleaning in a short time even if the work is a hard-to-clean part as described above.

In order to achieve the aforementioned object, according to a first aspect of the present invention, there is provided a cleaning apparatus comprising a cleaning chamber of vacuum-tight structure in which a work to be cleaned is contained, an organic solvent vapor generating tank communicated with the cleaning chamber via piping, and a vacuum pump for evacuating the cleaning chamber, wherein a heat exchange member through which a cooling medium passes is provided in the upper portion of the cleaning chamber.

In the cleaning apparatus according to the first aspect of the present invention, when loading the work into the cleaning chamber, evacuating the cleaning chamber by the vacuum pump, supplying the cooling medium into the heat exchange member, and then introducing the organic solvent vapor from the vapor generating tank into the cleaning chamber, the organic solvent vapor condenses on the surface of the work to make dew, forming liquid drops. The drops of organic solvent flow on the surface of the work, which results in cleaning of the work. Meanwhile, the vapor that has come into contact with the heat exchange member liquefies, dropping onto the work like a shower. As a result, the shower reduces heat transfer to the work surface, and at the same time results in cleaning of the work. Upon completion of cleaning, the cooling medium is no longer supplied to the heat exchange member, and the work is heated by condensing vapor so as to be dried.

Thus, according to the first aspect of the present invention, in the vapor cleaning process, the cooling medium is supplied to the heat exchange member disposed in the cleaning chamber. Therefore, the organic solvent vapor is liquefied by the heat exchange member so as to drop onto the work, reducing heat transfer to the work due to the condensing vapor. As a result, compared with the conventional cleaning apparatuses, the cleaning time can be controlled voluntarily, so that any work can be cleaned sufficiently.

Also, the so-called shower cleaning by liquefied solvent that drops down from the heat exchange member, is executed in addition to the conventional vapor cleaning. Thus, the cleaning effect is remarkably improved as compared with the conventional apparatuses.

According to a second aspect of the present invention, there is provided a cleaning apparatus wherein the organic solvent vapor generating tank is internally divided into a vapor generating chamber and a waste liquid recovery chamber, the two tanks each being communicated with the cleaning chamber via piping.

In the cleaning apparatus according to the second aspect of the present invention, used cleaning liquid composed of the liquefied organic solvent that has been used for cleaning in the cleaning chamber, oil, and other components are recovered in the waste liquid recovery chamber independent of the vapor generating chamber. Therefore, there is no possibility that the temperature of the heated organic solvent in the vapor generating tank may decrease or that the heating efficiency may deteriorate. As a consequence, the vapor is supplied with stability.

Thus, according to the second aspect of the present invention, the low-temperature liquefied organic solvent will not be mixed in the vapor generating chamber. Therefore, the heating efficiency of the organic solvent is improved, while the vapor is generated stably, so that the cleaning effect is improved.

According to a third aspect of the present invention, there is provided a cleaning apparatus wherein at least two of the vapor generating tanks are provided, and the vapor generating tanks are switched therebetween as required.

In the cleaning apparatus according to the third aspect of the present invention, if the low-temperature cleaning liquid that has been accumulated in lower part of the cleaning chamber is returned to the vapor generating tank after the cleaning of the work by one of the vapor generating tanks, the temperature of the organic solvent in the tank would decrease. Thus, the vapor generating tank is switched to another, in which state the cleaning is carried out in the above-mentioned way.

Thus, according to the third aspect of the present invention, the cleaning apparatus comprises two or more independent vapor generating tanks. Therefore, even if the organic solvent in a vapor generating tank has decreased in temperature on the account that the low-temperature organic solvent liquefied in the cleaning chamber is returned to the tank, vapor cleaning can be continued with the vapor generating tank switched to another. By virtue of this, the vapor cleaning can be executed stably and continuously over many times without being affected by any decrease in the solvent temperature. Besides, the cleaning cycle can be shortened. Moreover, even if the work is a hard-to-clean part such a part having a complex configuration, it can be cleaned repeatedly in a short cycle.

According to a fourth aspect of the present invention, there is provided a cleaning apparatus wherein the heat exchange member can be supplied with either cooling medium or heating medium selectively.

In the cleaning apparatus according to the fourth aspect of the present invention, a cleaning process by vapor and liquid drops is executed with a cooling medium supplied, whereas a cleaning process by only vapor is executed with a heating medium supplied.

Thus, according to the fourth aspect of the present invention, effective cleaning relating to the degree of oil adhesion on the work can be achieved by combining the cleaning by shower with the cleaning by vapor, with the cooling medium and the heating medium properly selected. Further, since the temperature of the heat exchange member can be switched from low to high temperature promptly by supplying a heating medium to the heat exchange member after the cleaning process, the vapor cleaning process can be succeeded by the next vapor heating process in a short time, so that the processing time for cleaning can be shortened.

As an alternative of the fourth aspect, the cleaning apparatus may further comprise a heating means for heating the cooling medium to be supplied within the heat exchange member.

In addition, in the cleaning apparatus according to any one of the foregoing aspects, it is preferable that a porous member is installed below the heat exchange member so that liquid condensed from the organic solvent vapor by the heat exchange member drops uniformly onto the work through the porous member.

Moreover, the cleaning apparatus may further comprise a discharging means for discharging the cooling medium within the heat exchange member when the cooling medium is stopped from being supplied.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Figure 1:
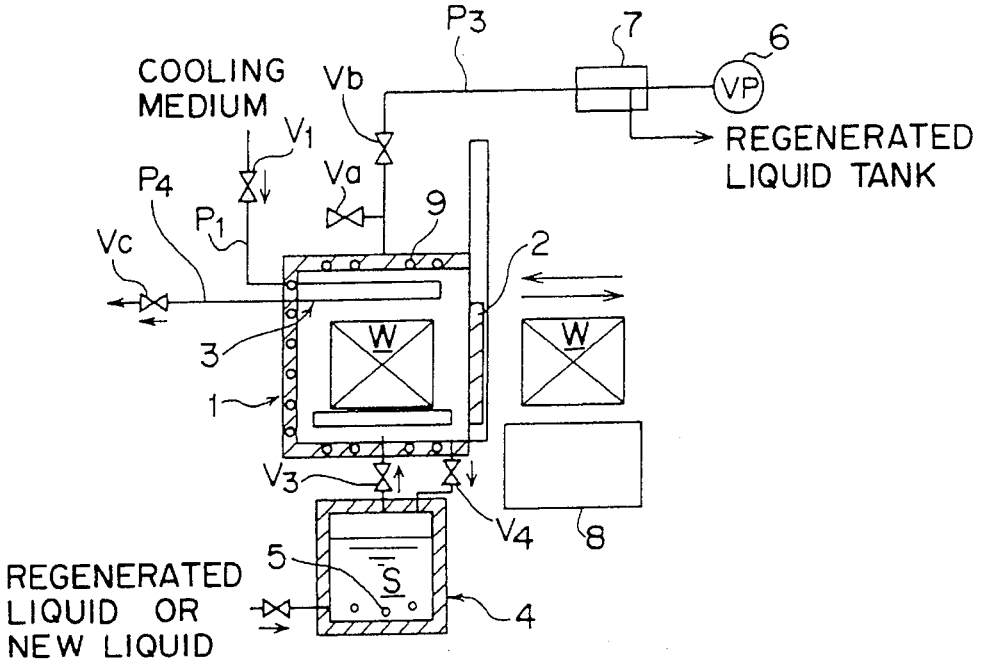
FIG. 1 is a schematic sectional view of a first embodiment of the cleaning apparatus according to the present invention.

FIG. 1 shows a first embodiment of the cleaning apparatus according to the present invention.

This cleaning apparatus is generally composed of a cleaning chamber 1 with a heat exchange member 3, a vapor generating tank 4, and a vacuum pump 6.

The cleaning chamber 1 is of vacuum-tight structure and has a door 2. A heater 9 is buried in the wall of the cleaning chamber 1.

The heat exchange member 3 is formed from fin-tube, and located in an upper portion of the cleaning chamber 1. Cooling-medium supply piping $P_1$ having an valve $V_1$ is connected to the inlet side of the heat exchange member 3, while piping $P_4$ having a flow regulating valve Vc is connected to the outlet side. Thus, the cooling medium can be supplied into the heat exchange member 3.

The vapor generating tank 4 is disposed below the cleaning chamber 1 and has therein a heater 5 for heating an organic solvent S. The top of the vapor generating tank 4 is communicated with the bottom of the cleaning chamber 1 via a vapor-introducing valve $V_3$ and a liquid return valve $V_4$.

The vacuum pump 6 is to evacuate the cleaning chamber 1 via piping $P_3$ and is communicated with the interior of the cleaning chamber 1 via an air introducing valve Va, a main evacuating valve Vb, and a condenser 7.

Figure 3:
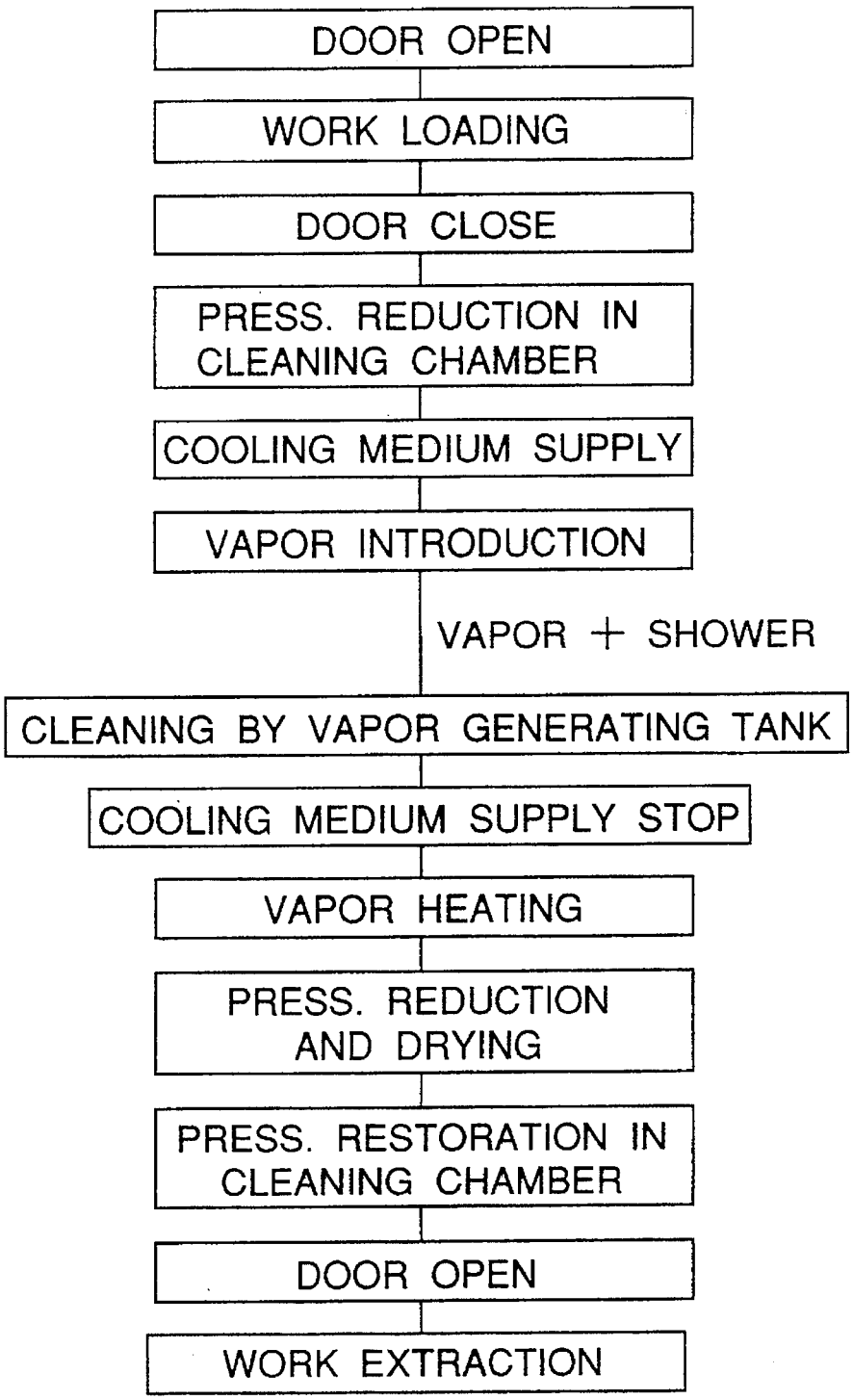
FIG. 3 is a process diagram showing the cleaning process by the apparatus of FIG. 1.

The operation of the cleaning apparatus constructed as above is described hereinafter with reference to FIGS. 1 and 3.

First, the door 2 is opened. A work W placed on a table 8 is loaded into the cleaning chamber 1 and the door 2 is closed.

Next, with the vacuum pump 6 driven and the main evacuating valve Vb opened, the cleaning chamber 1 is evacuated to not more than $1.4\times10^3$ Pa (10 Torr), and then the main evacuating valve Vb is closed. At the same time, with the valve $V_1$ and the flow regulating valve Vc opened, a cooling medium is supplied into the heat exchange member 3.

Then, when the vapor-introducing valve $V_3$ and the liquid return valve $V_4$ are opened, the vapor that has been generated in the vapor generating tank 4 is introduced via the vapor-introducing valve $V_3$ into the cleaning chamber 1 by a pressure difference. The introduced vapor condenses on the surface of the work W to make dew because of low surface temperature of the work W. This dew grows on the entire surface of the work W to drop down, whereby the vapor cleaning of the work W is accomplished.

In connection to this, if the surface temperature of the work W gradually increases so as to be equal to the temperature of the vapor by the vapor coming into contact with the surface of the work W, and if the saturated vapor pressure and the internal pressure of the cleaning chamber 1 become equal to each other, the vapor cleaning would be impossible (prior art). However, in the present embodiment, the cooling medium passes through the heat exchange member 3, so that the temperature of the heat exchange member 3 is normally held lower than the temperature of vapor. Accordingly, the vapor introduced into the cleaning chamber 1 is liquefied by making contact with the heat exchange member 3, the resultant liquid dropping onto the work W. The liquid drops cool the surface temperature of the work W below the vapor temperature. As a result, the vapor cleaning is continued.

Further, in addition to the cleaning by vapor, the so-called shower cleaning is performed by liquid drops derived from the heat exchange member 3. Accordingly, the cleaning effect is further enhanced. The organic solvent S that has dropped and accumulated at the bottom of the cleaning chamber 1 is returned into the vapor generating tank 4 through the liquid-return valve $V_4$.

Now that the surface of the work W has been sufficiently cleaned in the above-described manner, the valve $V_1$ is closed so that the cooling medium is stopped from being supplied to the heat exchange member 3. Meanwhile, vapor continues to be introduced into the cleaning chamber 1, whereby the work W is heated by vapor.

Then, after vapor heating is executed for a specified time, the vapor-introducing valve $V_3$ and the liquid return valve $V_4$ are closed and then the main evacuating valve Vb is opened to operate the vacuum pump 6. Thus, with reduced internal pressure of the cleaning chamber 1, the work W is subjected to a drying process. Vapor sucked up from the cleaning chamber 1 is liquefied by the condenser 7 and regenerated for reuse.

Upon completion of the drying process, the main evacuating valve Vb is closed. The vacuum pump 6 is stopped and the air introducing valve Va is opened, so that the internal pressure of the cleaning chamber 1 is restored. Then, with the door 2 opened, the work W is extracted. Thus, the cleaning of the work W is completed. Thereafter, the next work W is cleaned in the same way as above.

It is noted that the temperature of the cleaning chamber 1 is maintained by the heater 9 throughout the above processes.

Other embodiments of the present invention are now described. Unless specifically described, the embodiments are similar to the foregoing first embodiment. Therefore, the elements of the embodiments corresponding to those of the first embodiment are designated by like numerals and omitted in description.

Figure 2:
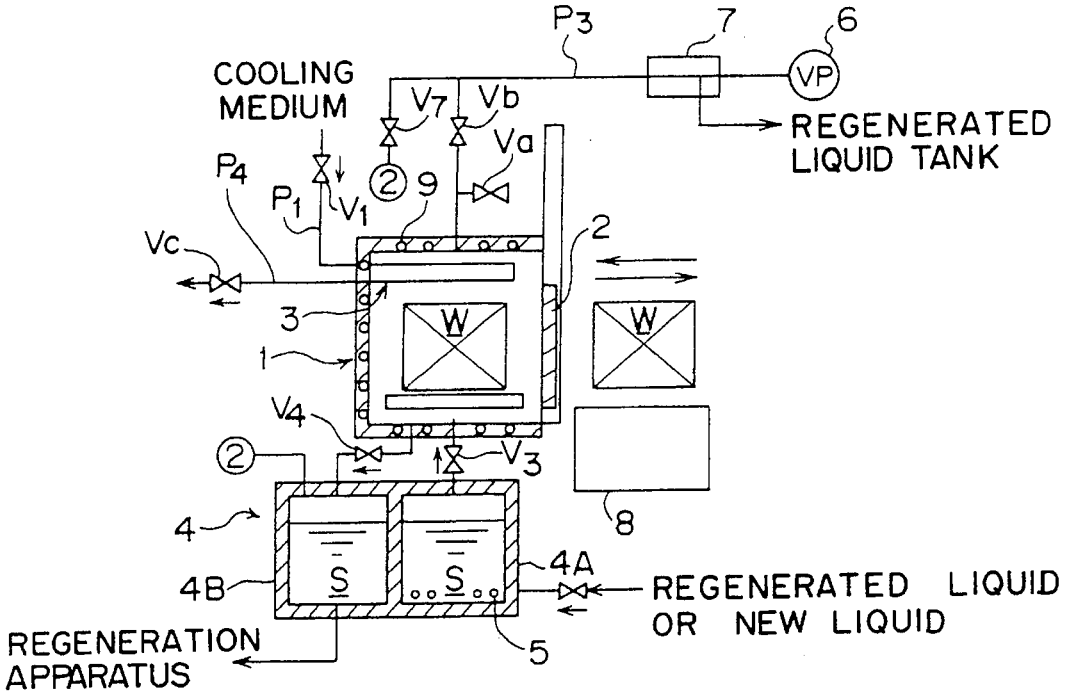
FIG. 2 is a schematic sectional view of a second embodiment of the cleaning apparatus according to the present invention.

FIG. 2 shows a second embodiment of the cleaning apparatus according to the present invention.

In this cleaning apparatus, a vapor generating tank 4 is divided into two chambers separated from each other, one being a vapor generating chamber 4A and the other being a waste liquid recovery chamber 4B. The two chambers 4A, 4B may be constructed either integrally or independently. The vapor generating chamber 4A, having a heater 5 for heating an organic solvent S, is so arranged that it can introduce vapor of the organic solvent S into a cleaning chamber 1 via a vapor-introducing valve $V_3$. The waste liquid recovery chamber 4B is so arranged that it recovers used cleaning liquid composed of the organic solvent S, which has been used for cleaning in the cleaning chamber 1 and liquefied, oil, and the like via a liquid return valve $V_4$. The top of the waste liquid recovery chamber 4B is communicated with piping $P_3$ via a valve $V_7$.

In the apparatus of the first embodiment of FIG. 1 as described above, since the organic solvent S liquefied in the cleaning chamber 1 is returned to the vapor generating tank 4, the temperature of the organic solvent S heated in the vapor generating tank 4 would decrease such that the heating efficiency would deteriorate, such that stable vapor supply could not be attained in some cases. However, in the apparatus of this second embodiment, since the vapor generating tank 4 is divided into the two chambers of the vapor generating chamber 4A and the waste liquid recovery chamber 4B, the heating efficiency in the vapor generating chamber 4A is improved and a stable vapor supply can be obtained. Further, since the waste liquid recovery chamber 4B is reduced in pressure by opening the valve $V_7$, the recovery efficiency of waste liquid is improved.

Figure 4:
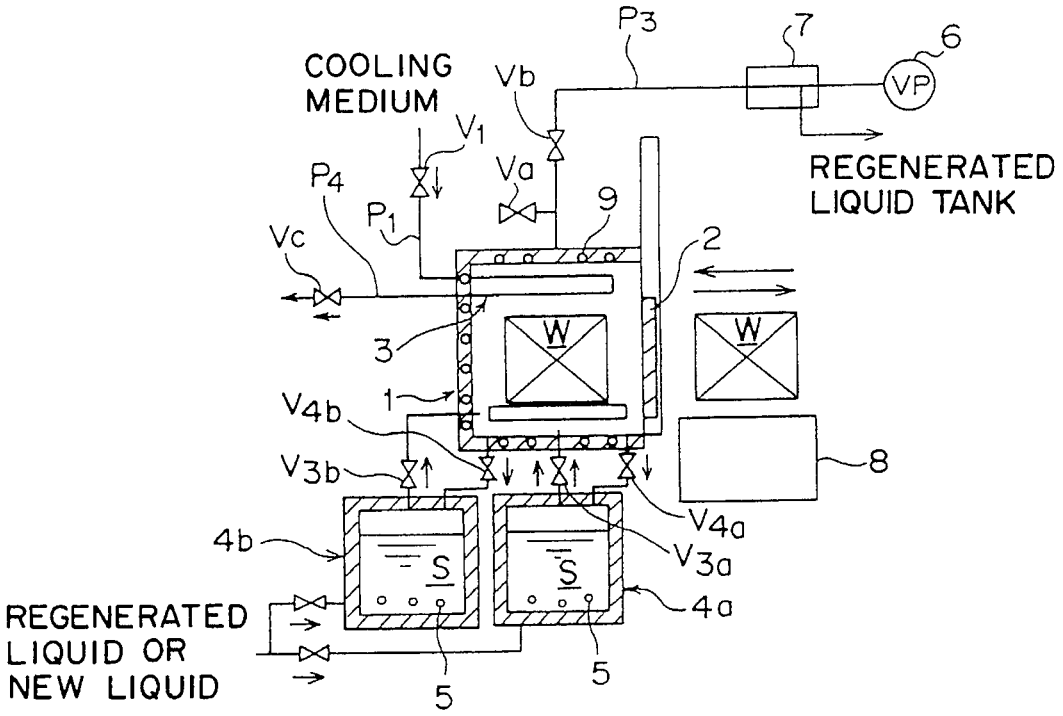
FIG. 4 is a schematic sectional view of a third embodiment of the cleaning apparatus according to the present invention.

FIG. 4 shows a third embodiment of the cleaning apparatus according to the present invention.

In this cleaning apparatus, there are provided two vapor generating tanks, a first vapor generating tank **4*a* and a second vapor generating tank 4*b*. These first and second vapor generating tanks 4*a*, 4*b* are of the same structure independent of each other, and each have therein a heater 5 for heating an organic solvent S. The top of the vapor generating tanks 4*a*, 4*b* is communicated with the bottom of the cleaning chamber 1** via piping with vapor-introducing valves $V_3a$, $V_3b$ and via piping with liquid return valves $V_4a$, $V_4b$, respectively.

Next, the operation of the cleaning apparatus constructed as above is explained.

Figure 5:
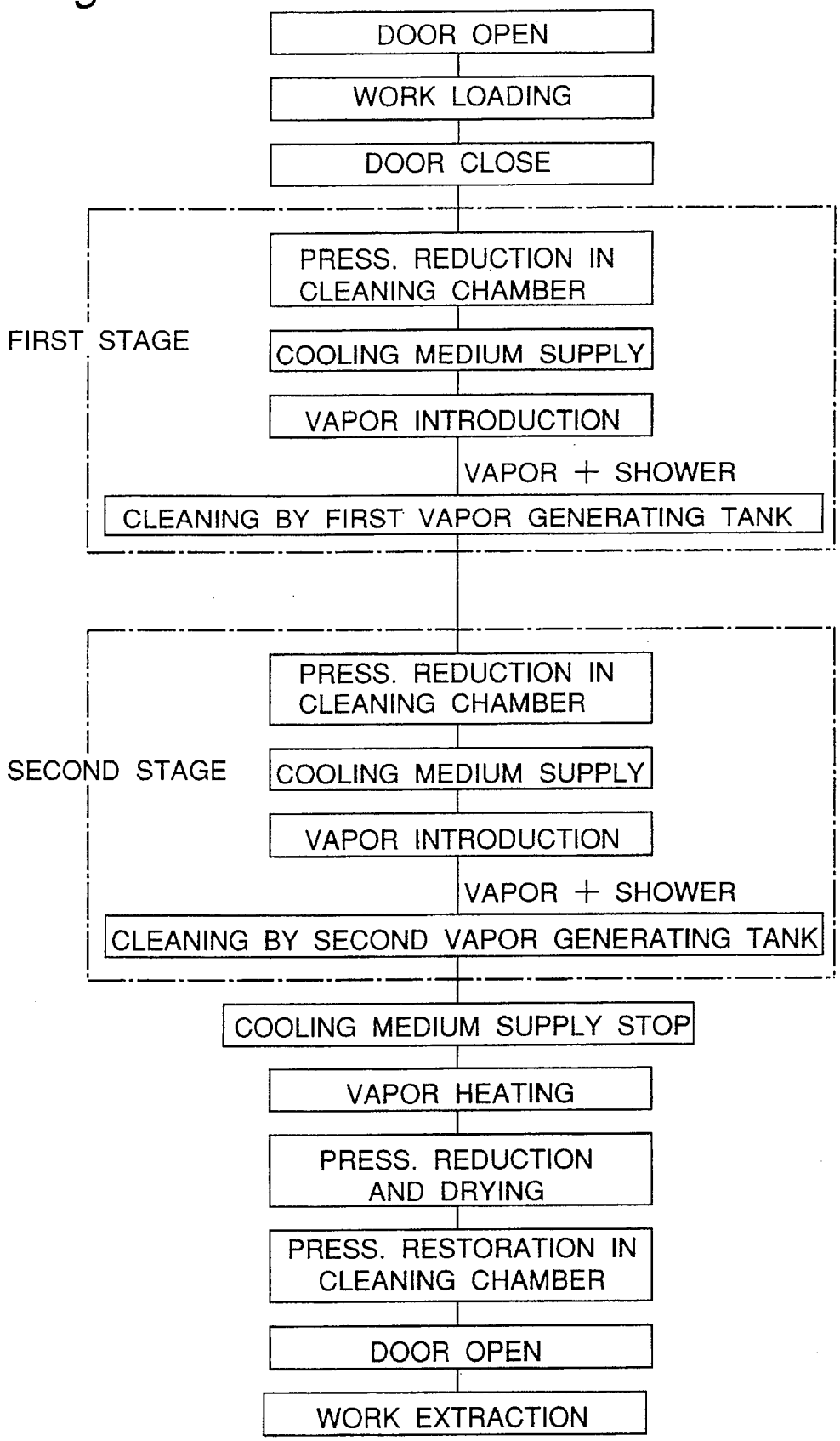
FIG. 5 is a process diagram showing the cleaning process by the apparatus of FIG. 4.

The operation of this cleaning apparatus, as shown in FIG. 5, is capable of performing a first-stage cleaning by the first vapor generating tank **4*a* and a second-stage cleaning by the second vapor generating tank 4*b***. When the work W is a part having little oil adhesion or a part of relatively simple configuration, only the first-stage cleaning is implemented. However, for hard-to-clean parts such as parts with greater oil adhesion, parts with high-viscosity oil adhesion, or parts having a complex configuration, the first-stage and second-stage cleaning are carried out in succession. Now a case where the first to second stages are performed is described in detail hereinbelow.

First, in the first-stage cleaning, with the door 2 opened, a work W is loaded into the cleaning chamber 1. After the door 2 is closed, the internal pressure of the cleaning chamber 1 is reduced by the vacuum pump 6. Then, a cooling medium is supplied into the heat exchange member 3. With the vapor-introducing valve $V_3a$ and the liquid return valve $V_4a$ opened, the vapor that has been generated in the first vapor generating tank **4*a* is introduced into the cleaning chamber 1. Thus, as in the first embodiment, the vapor condenses to make dew and fluidly moves on the surface of the work W, whereby the vapor cleaning of the work W is accomplished. At the same time, the vapor is cooled by the heat exchange member 3 so as to be liquefied, dropping onto the work W, whereby the shower cleaning is performed. The organic solvent S that has dropped and accumulated at the bottom of the cleaning chamber 1 is returned through the liquid return valve $V_4a$ into the first vapor generating tank 4*a***.

The organic solvent S that is returned to the first vapor generating tank 4*a* after having contributed to the above cleaning process has decreased in temperature, causing the organic solvent S within the first vapor generating tank 4*a* to decrease in temperature. As a result, if the aforementioned first-stage cleaning by the first vapor generating tank 4*a* is continued, the vapor could no longer be supplied stably. Also, if time is allowed to elapse until the temperature of the organic solvent S in the first vapor generating tank 4*a* is restored up to a specified set temperature, the result would be a longer processing time. Thus at a point in time when the temperature of the organic solvent S within the first vapor generating tank 4*a* has lowered below the specified set temperature, the air introducing valve Va is opened and the internal pressure of the cleaning chamber 1 is restored to $13\times10^3$ to $20\times10^3$ Pa (100 to 150 Torr), so that the cleaning liquid that has accumulated at the bottom of the cleaning chamber 1 is returned to the first vapor generating tank 4*a*. Then, immediately after the vapor-introducing valve $V_3$a and the liquid return valve $V_4$a are closed, the process is switched to the next second-stage cleaning by the second vapor generating tank 4*b*.

In the second-stage cleaning, the vacuum pump 6 is driven once again and moreover the main evacuating valve Vb is opened so that the internal pressure of the cleaning chamber 1 is reduced to lower than $1.4\times10^3$ (10 Torr). Thereafter, the cooling medium is supplied to the heat exchange member 3. With the vapor-introducing valve $V_3$b and the liquid return valve $V_4$b opened, the organic solvent vapor is introduced from the second vapor generating tank 4*b* into the cleaning chamber 1. From this on, cleaning of the work W continues in the same way as in the first stage.

The processing after such first- and second-stage cleaning of the work W has been finished is similar to that in the first embodiment and therefore omitted in description.

Figure 6:
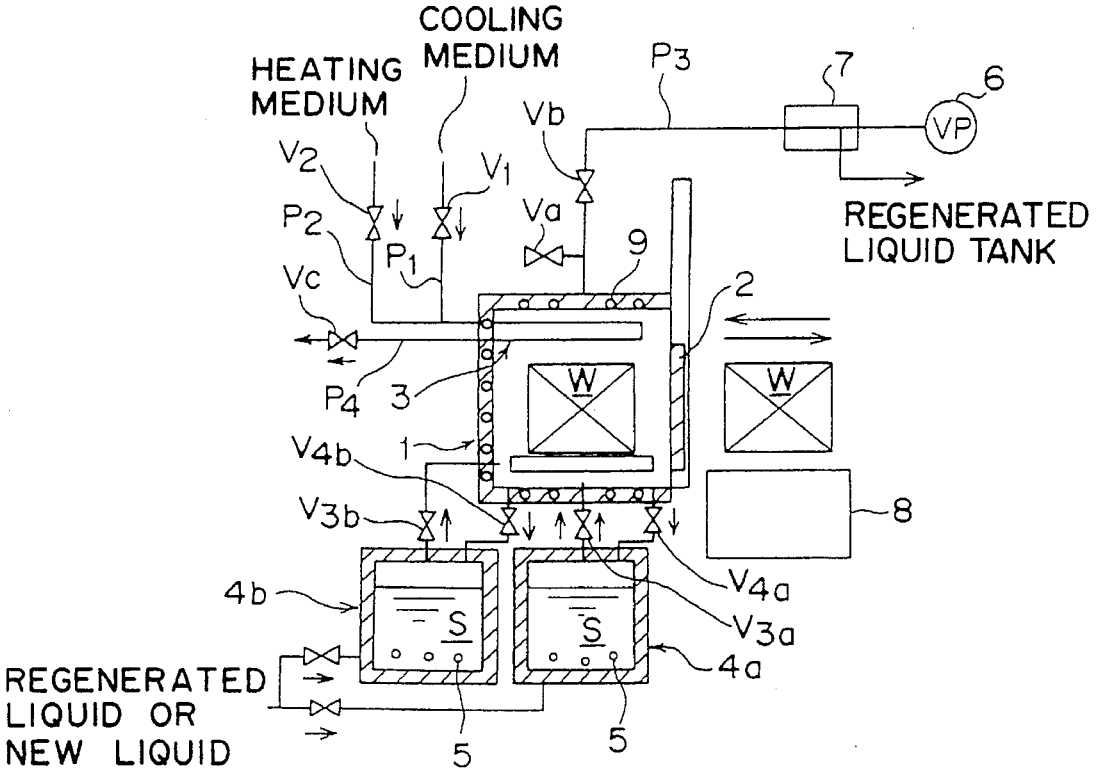
FIG. 6 is a schematic sectional view of a fourth embodiment of the cleaning apparatus according to the present invention.

FIG. 6 shows a fourth embodiment of the cleaning apparatus according to the present invention.

This cleaning apparatus is so arranged that heating-medium supply piping $P_2$ having a valve $V_2$ is additionally provided so as to be branched from cooling-medium supply piping $P_1$, whereby steam or hot air is supplied to the heat exchange member 3. In this apparatus, either cooling medium or heating medium can be selected and supplied to the heat exchange member 3 by opening either valve $V_1$ or $V_2$.

The operation of this cleaning apparatus is capable of performing the first- and second-stage cleaning of the work W as in the third embodiment. Moreover, by selecting the heat medium, which is supplied to the heat exchange member 3, at the time of starting the cleaning, or by switching it during the cleaning, an effective cleaning matching the degree of oil adhesion or the cleaning conditions of the work W can be implemented.

Figure 7:
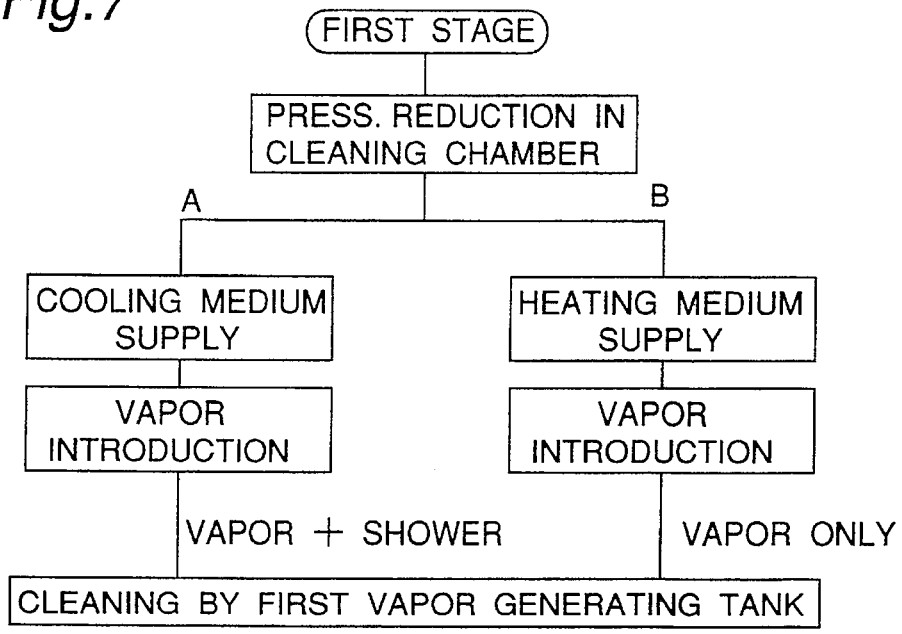
FIG. 7 is a process diagram showing the first stage of the cleaning process by the apparatus of FIG. 6.

In more detail, the first-stage cleaning process by the first vapor generating tank 4*a* can be selected from a process A and a process B as shown in FIG. 7.

In the process A as shown in FIG. 7, the internal pressure of the cleaning chamber 1 is reduced while a cooling medium is supplied into the heat exchange member 3, in which state the vapor of the organic solvent S is introduced. Therefore, it is possible to implement a cleaning in combination of the vapor cleaning, in which the vapor condenses on the surface of the work W, and the shower cleaning, in which the vapor is liquefied by the heat exchange member 3 and drops onto the work W.

In the process B as shown in FIG. 7, the internal pressure of the cleaning chamber 1 is reduced while a heating medium is supplied into the heat exchange member 3, in which state the vapor of the organic solvent S is introduced. Therefore, the vapor will not be liquefied by the heat exchange member 3, so that only the vapor cleaning can be implemented.

Figure 8:
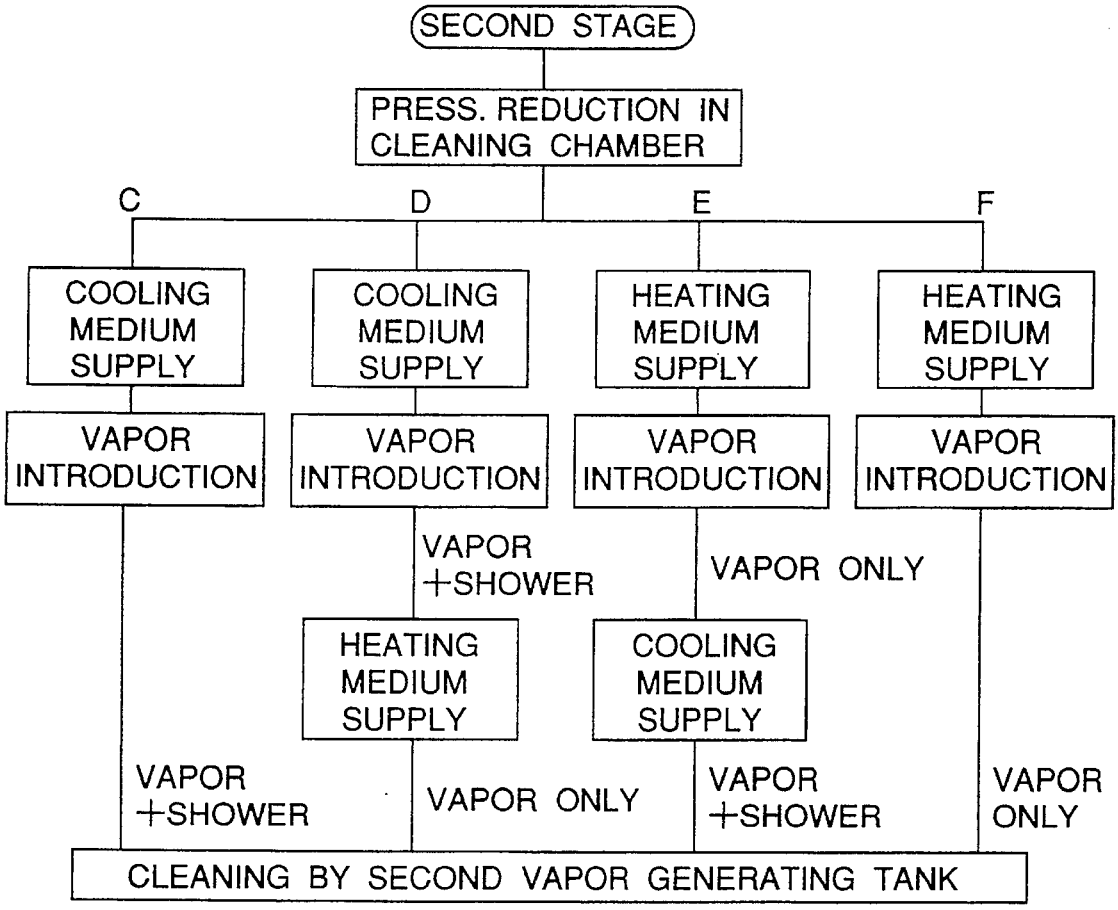
FIG. 8 is a process diagram showing the second stage of the cleaning process by the apparatus of FIG. 6.

On the other hand, the second-stage cleaning by the second vapor generating tank 4*b* can be selected from a process C, a process D, a process E, and a process F as shown in FIG. 8.

In the process C as shown in FIG. 8, the internal pressure of the cleaning chamber 1 is reduced while the cooling medium is supplied into the heat exchange member 3, in which state the vapor of the organic solvent S is introduced. Therefore, it is possible to implement a cleaning in combination of the vapor cleaning and the shower cleaning.

In the process D as shown in FIG. 8, the internal pressure of the cleaning chamber 1 is reduced while the cooling medium is supplied into the heat exchange member 3, in which state the vapor of the organic solvent S is introduced. Therefore, it is possible to implement a cleaning in combination of the vapor cleaning and the shower cleaning, as in the process C. After the cleaning, if the medium supplied to the heat exchange member 3 is switched from cooling medium to heating medium with the valve $V_1$ closed and the valve $V_2$ opened, then a finish cleaning and heating of the work W by vapor can be implemented.

In the foregoing process C, when the cleaning with the use of vapor and shower in combination is completed, the cooling medium is stopped from being supplied into the heat exchange member 3. Therefore, the solvent vapor continues being liquefied until the temperature of the heat exchange member 3 becomes equal to the temperature of the vapor, so that it takes longer time to proceed to the next vapor heating process, resulting in waste of time. However, in the process D, since the completion of the cleaning by the use of vapor and shower in combination is immediately succeeded by the switching to the heating medium, the heat exchange member 3 rapidly increases in temperature above the vapor temperature, so that the vapor can be stopped from condensing without wasting time.

In the process E as shown in FIG. 8, the internal pressure of the cleaning chamber 1 is reduced while the heating medium is supplied into the heat exchange member 3, in which state the vapor of the organic solvent S is introduced. Therefore, only the vapor cleaning is performed. After the cleaning, if the medium supplied to the heat exchange member 3 is switched from heating medium to cooling medium with the valve $V_2$ closed and the valve $V_1$ opened, then a finish cleaning of the work W by vapor and shower can be implemented.

In the process F as shown in FIG. 8, the internal pressure of the cleaning chamber 1 is reduced while the heating medium is supplied into the heat exchange member 3, in which state the vapor of the organic solvent S is introduced. Therefore, only the vapor cleaning is performed.

The process A or B in the first stage and the processes C through F in the second stage can be selected at the discretion of the operator according to the degree of difficulty in cleaning the work W.

Figure 9:
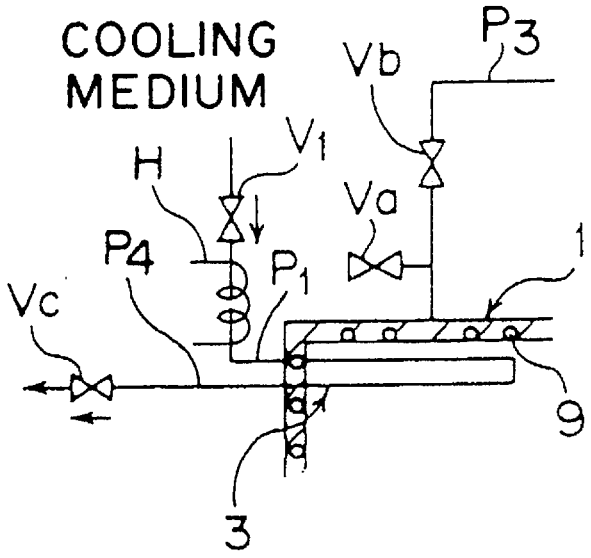
FIG. 9 is a view showing a first modification of FIGS. 1, 2 and 4.

It is noted that a heating means H such as a heater may be additionally provided to the cooling-medium supply piping $P_1$ as shown in FIG. 9. In this case, the cooling-medium supply piping $P_1$ is heated by this heating means H, then similar processes can be adopted without providing the heat exchange piping $P_2$ as in the fourth embodiment.

Figure 10:
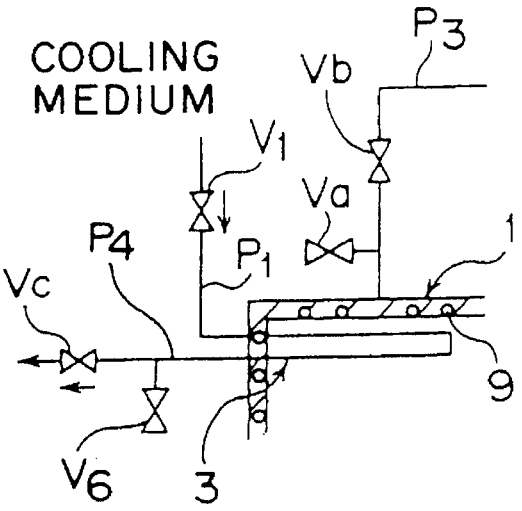
FIG. 10 is a view showing a second modification of FIGS. 1, 2, 4 and 6.

Also, as shown in FIG. 10, a valve $V_6$ may be provided so as to be branched by piping on the primary side of the flow regulating valve Vc. In this case, the supply of the cooling medium is stopped by closing the valve $V_1$, and the cooling medium in the heat exchange member 3 is discharged by opening the valve $V_6$, whereby the temperature increasing time for the heat exchange member 3 can be shortened.

Figure 11:
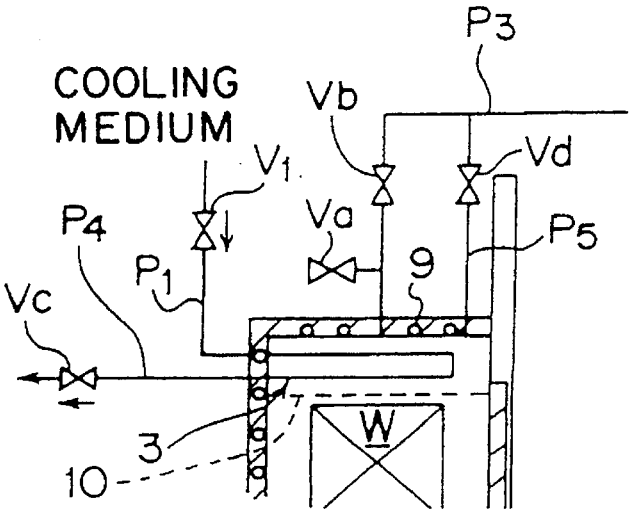
FIG. 11 is a view showing a third modification of FIGS. 1, 2, 4 and 6.

Further, as shown in FIG. 11, it may also be arranged that a porous member 10 such as a metal mesh is installed below the heat exchange member 3 so that liquid drops uniformly onto the work W. It is also possible that by-pass exhaust piping $P_5$ having a valve Vd for evacuating the cleaning chamber 1 is provided on the secondary side of the main evacuating valve Vb. In this case, the vacuum pump 6 is driven by opening the valve Vd for vapor cleaning and vapor heating, so that the vapor in the cleaning chamber 1 forms a flow in a constant direction.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being include therein.

What is claimed is:

1. A cleaning apparatus comprising a cleaning chamber of vacuum-tight structure in which a work to be cleaned is contained, an organic solvent vapor generating tank communicated with the cleaning chamber via piping, and a vacuum pump for evacuating the cleaning chamber, wherein a heat exchange member to which a cooling medium supply piping is connected is provided in an upper portion of the cleaning chamber, and wherein a heating medium supply piping is provided so as to be branched from said cooling medium supply piping outside the cleaning chamber, whereby said heat exchange member can be supplied with either cooling medium or heating medium selectively.

2. A cleaning apparatus as claimed in claim 1, wherein said organic solvent vapor generating tank is internally divided into a vapor generating chamber and a waste liquid recovery chamber, the two chambers being each communicated with the cleaning chamber via piping.

3. A cleaning apparatus as claimed in claim 1, wherein at least two of said vapor generating tanks are provided, and the vapor generating tanks are switched therebetween as required.

4. A cleaning apparatus as claimed in any one of claims 1 to 3, wherein a porous member is installed below said heat exchange member so that liquid condensed from the organic solvent vapor by the heat exchange member drops uniformly onto the work through the porous member.

5. A cleaning apparatus as claimed in any one of claims 1 to 3, further comprising a discharging means for discharging the cooling medium within the heat exchange member.

6. A method for cleaning a work with oil adhering thereto by organic solvent vapor introduced into a cleaning chamber of vacuum-tight structure from an organic solvent vapor generating tank communicated with the cleaning chamber via piping, said cleaning chamber comprising a heat exchange member which can be supplied with either cooling medium or heating medium selectively and a vacuum pump for evacuating the cleaning chamber, comprising:

a first step of evacuating the cleaning chamber into which the work is loaded;

a second step of supplying the cooling medium into the heat exchanger member and introducing the organic solvent vapor into the cleaning the chamber;

a third step of stopping the supply of cooling medium to supply the heating medium into the heat exchanger member and heating the work by the organic solvent vapor;

a fourth step of stopping the introduction of the organic solvent vapor and reducing the internal pressure of the cleaning chamber to dry the work; and a fifth step of restoring the internal pressure of the cleaning chamber to the atmospheric pressure to extract the work from the cleaning chamber.

7. A method for cleaning work with oil adhering thereto by organic solvent vapor introduced into a cleaning chamber of vacuum-tight structure from two organic solvent vapor generating tanks communicated with the cleaning chamber via piping, said cleaning chamber comprising a heat exchange member which can be supplied with either cooling medium or heating medium selectively and a vacuum pump for evacuating the cleaning chamber, comprising:

a first step of evacuating the cleaning chamber into which the work is loaded;

a second step of supplying the cooling medium into the heat exchanger member and introducing the organic solvent vapor into the cleaning chamber from any one of the organic solvent vapor generating tanks;

a third step of stopping the introduction of organic solvent vapor from the one of the organic solvent vapor generating tanks and introducing the organic solvent vapor into the cleaning chamber from the other of the organic solvent vapor generating tanks after reducing the internal pressure of the cleaning chamber;

a fourth step of stopping the supply of cooling medium to supply the heating medium into the heat exchanger member and heating the work by the organic solvent vapor;

a fifth step of stopping the introduction of the organic solvent vapor and reducing the internal pressure of the cleaning chamber to dry the work; and a sixth step of restoring the internal pressure of the cleaning chamber to the atmospheric pressure to extract the work from the cleaning chamber.

8. A method for cleaning a work with oil adhering thereto by organic solvent vapor introduced into a cleaning chamber of vacuum-tight structure from two organic solvent vapor generating tanks communicated with the cleaning chamber via piping, said cleaning chamber comprising a heat exchange member which can be supplied with either cooling medium or heating medium selectively and a vacuum pump for evacuating the cleaning chamber, comprising:

a first step of evacuating the cleaning chamber into which the work is loaded;

a second step of supplying the heating medium into the heat exchanger member and introducing the organic solvent vapor into the cleaning chamber from any one of the organic solvent vapor generating tanks;

a third step of stopping the supply of the heating medium as well as the introduction of organic solvent vapor from the one of the organic solvent vapor generating tanks and introducing the organic solvent vapor into the cleaning chamber from the other of the organic solvent vapor generating tanks after reducing the internal pressure of the cleaning chamber as well as supplying the cooling medium into the heat exchanger member;

a fourth step of stopping the supply of cooling medium to supply the heating medium into the heat exchanger member and heating the work by the organic solvent vapor;

a fifth step of stopping the introduction of the organic solvent vapor and reducing the internal pressure of the cleaning chamber to dry the work; and a sixth step of restoring the internal pressure of the cleaning chamber to the atmospheric pressure to extract the work from the cleaning chamber.

9. A cleaning apparatus comprising a cleaning chamber of vacuum-tight structure in which a work to be cleaned is contained, an organic solvent vapor generating tank communicated with the cleaning chamber via piping, and a vacuum pump for evacuating the cleaning chamber, wherein a heat exchange member through which a cooling medium passes is provided in an upper portion of the cleaning chamber wherein said organic solvent vapor generating tank is internally divided into a vapor generating chamber and a waste recovery chamber, the two chambers being each communicated with the cleaning chamber via piping.

* * * * *